United States Patent [19]

Kennedy

[11] Patent Number: 4,803,855

[45] Date of Patent: Feb. 14, 1989

[54] SINGLE SHAFT AGITATE AND SPIN DRIVE FOR AUTOMATIC WASHER

[75] Inventor: William L. Kennedy, Coloma Township, Berrien County, Mich.

[73] Assignee: Whirlpool Corporation, Benton Harbor, Mich.

[21] Appl. No.: 83,183

[22] Filed: Aug. 10, 1987

[51] Int. Cl.[4] ..... D06F 13/02

[52] U.S. Cl. ..... 68/23.7; 68/133; 464/160

[58] Field of Search ..... 464/92, 96, 160; 68/23.6, 23.7, 133

[56] References Cited

U.S. PATENT DOCUMENTS

| | | | |
|---|---|---|---|
| 1,557,525 | 10/1925 | Hanson | 464/160 |
| 2,270,080 | 1/1942 | Oakley | 68/133 UX |
| 2,273,566 | 2/1942 | Faber | 68/133 |
| 2,609,697 | 9/1952 | Ruscoe . | |
| 2,699,683 | 1/1955 | Castner . | |
| 2,816,450 | 12/1957 | Conlee | 68/133 X |
| 2,920,502 | 1/1960 | Bungart | 464/160 X |
| 3,248,908 | 5/1966 | Pope . | |
| 3,922,884 | 12/1975 | Chapman | 464/160 X |
| 4,059,975 | 11/1977 | Jacobs . | |
| 4,405,040 | 9/1983 | Buschbom et al. . | |
| 4,661,085 | 4/1987 | Carli | 464/160 |

*Primary Examiner*—Harvey C. Hornsby
*Assistant Examiner*—Frankie L. Stinson
*Attorney, Agent, or Firm*—Hill, Van Santen, Steadman & Simpson

[57] ABSTRACT

A single shaft agitate and spin drive for an automatic washer is provided in which a lost motion mechanism or clutch in the form of a plurality of stacked discs is mounted on the agitator shaft, a lower end of the mechanism being driven by the agitator shaft and an upper end of the mechanism driving the basket after a sufficient amount of rotation by the agitator has been inputted to the mechanism. The mechanism absorbs enough rotational motion to allow oscillatory motion of the agitator without transmission of that motion to the basket, but if sufficient rotational motion is input to the mechanism, such as during the spin mode, the mechanism transmits the motion to drive the basket. The amount of rotation absorbed is easily changed by changing the number of discs in the stack.

12 Claims, 3 Drawing Sheets

SINGLE SHAFT AGITATE AND SPIN DRIVE FOR AUTOMATIC WASHER

BACKGROUND OF THE INVENTION

1. Field of the Invention

The present invention relates to a drive mechanism for an automatic washer and more particularly to a device to allow for a delay between the start of rotation of a driving member and the start of rotation of the driven member in an automatic washer agitator drive.

2. Description of the Prior Art

In the drive of an automatic washer, the agitator is driven either in a back and forth agitate motion or in a single direction spin motion depending on the particular portion of the wash cycle. Various clutching mechanisms have been provided in the prior art to provide a transition between oscillatory agitation motion and rotating spin motion.

U.S. Pat. No. 2,609,697 discloses a drive dog 42 depending downwardly from the agitator skirt which engages a drive dog 43 on the basket to carry the agitator and basket together during a spin mode and during the agitate mode it is stated that the downwardly depending dog 42 will push the basket dog 43 out of the way during the first oscillation and then will not contact it during subsequent oscillation.

U.S. Pat. No. 3,248,908 uses an inner and outer helical spring type clutch 30 to permit oscillatory motion of the agitator without causing oscillation of the basket, but continued rotation in one direction during spin will cause the clutch 32 engage thus spinning the basket with the agitator.

U.S. Pat. No. 4,059,975 uses a pivoting arm 180 to alternatively be engaged by opposed cam surfaces on adjacent pulleys which are rotated in opposite directions to result in oscillatory motion when the pulleys are rotated in a first direction and results in a spinning of the agitator when the pulleys are rotated in a second direction.

It is desirable in washers to provide a means for driving the basket and agitator in a spin mode and only the agitator in an agitate mode. All the prior art has provided some solutions for providing this function, these solutions are somewhat complicated and use involved clutching mechanisms and connecting parts.

Therefore, it would be an improvement in the art if there were provided a simple, yet effective means for permitting oscillatory motion of the agitator without causing oscillatory motion of the basket, and for causing spinning of the basket upon a given rotation of the agitator, without the need for a complicated and expensive clutch arrangement.

SUMMARY OF THE INVENTION

The present invention provides a rotational delay mechanism for a single shaft agitate and spin drive for automatic washers which permits the use of a single shaft to drive both the agitator and spin basket in a spin mode, but which permits oscillation of the agitator without rotational movement of the basket in a wash mode. Further, the present invention provides for a simplified clutch arrangement which is a rotational delay mechanism with means for easily varying the length of delay so that it can be assured that the agitator is free to oscillate through any given oscillatory stroke angle, even one of several rotations, without causing the spin basket to be driven, yet assuring that the spin basket will be driven in a spin direction after the agitator has been rotated beyond the preselected stroke angle.

The delay mechanism is comprised of a plurality of disc members to be stacked on the agitator shaft, each disc having opposed axially extending tab or lug portions such that the extending portion of one disc will abut against an extending portion of a neighboring disc after sufficient relative rotation of the two discs. A driver such as a pulley rotated by a motor drives a lowermost disc and an uppermost disc drives a spin tube attached to the basket. Thus, when stacked on the agitator shaft, each disc will be rotated a given number of degrees before its projection engages the projection on the next adjoining disc. During agitate, the driver rotates in its oscillating motion fewer degrees in one direction than is required for the combination of all the discs to rotate sufficiently to provide a driving input to the spin tube. The number of turns the disc adjacent the driver makes before the disc at the other end adjacent the spin tube begins to rotate is the angular delay and is determined by the number of discs and the size of the discs. When the driver rotates in a single direction, the lost motion device eventually locks up, providing a continuous rotational input to the spin tube.

Two different embodiments of the disc are disclosed as exemplary embodiments of the invention. In a first embodiment, the discs comprise a generally circular member with a central hole for passage of the agitator shaft and have two radially extending tabs, one tab being turned upwardly in an angled axial direction and the opposite tab being turned downwardly in an angled axial direction. Thus, when the discs are stacked on the agitator shaft, an upwardly turned tab will engage with a downwardly turned tab of the next adjacent disc to provide the driving connection between the discs. In this manner, each disc may provide at least approximately 340° of lost motion. If the disc is made of a larger diameter, and the tab remaining approximately the same size, then the effective angular width of the tab would be reduced such that a larger number of degrees of lost motion could be obtained from each disc.

A second embodiment illustrated in this disclosure comprises a disc with a planar lower surface broken only by a downwardly extending tab or lug axial projection molded as part of the disc close to the outer perimeter of the disc. The top side of the disc includes an upwardly extending rim extending around the entire periphery of the disc and an upwardly extending tab or lug projection, radially opposite the downwardly extending projection, which terminates coplanar with the perimeter wall. A central hub portion is also formed which extends upwardly from the disc so that an annular channel is formed in the top side throughout approximately 340° of the circumference of the disc, the remaining 20° being filled with the upward projection. When two such discs are stacked, the lower projection of the upper disc fits down into the annular channel of the lower disc and the discs are free to rotate relative to one another until the adjacent upward and downward projections abut. Then the two discs are carried together in a given rotational direction. In this embodiment there is also preferably provided an elastomeric bumper which is held in the topside of the disc and which projects to either side of the upwardly directed projection so that the bumper is engaged by the downwardly directed projection before that projection engages the upwardly extending projection thereby to act as a cushion and to avoid the impact of one projection against the other thereby to reduce or eliminate any noise associated with such impact.

As with the first embodiment, the amount of lost motion can be changed by changing disc size or number of discs. Thus, there is provided a simple, yet effective means for permitting oscillatory motion of the agitator without causing oscillatory motion of the basket, and for causing spinning of the basket upon a given rotation of the agitator, without the need for a complicated and expensive clutch arrangement.

DESCRIPTION OF THE PREFERRED EMBODIMENTS

Figure 1:
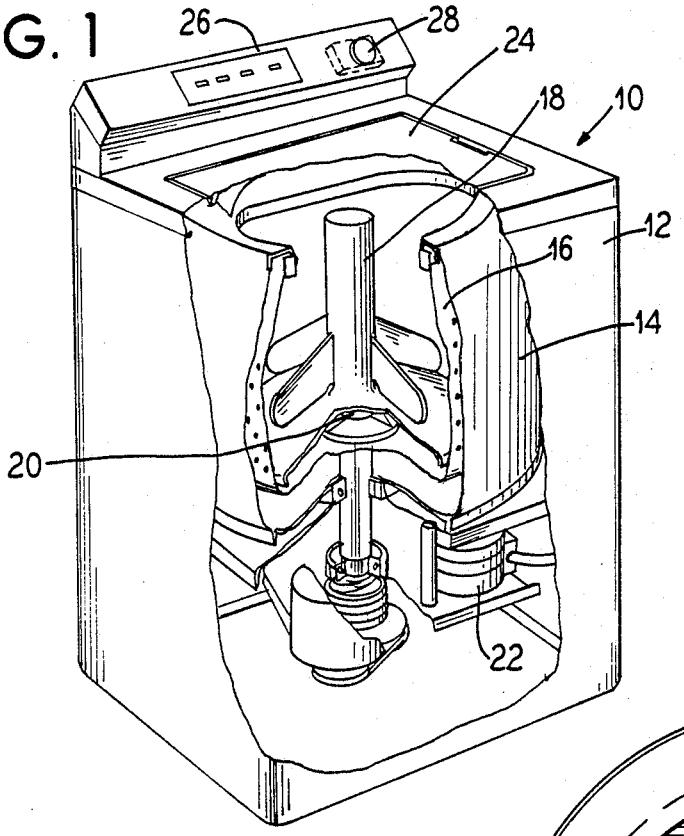
FIG. 1 is a perspective view of a washing machine, partially cut away, embodying the principles of the present invention.

In FIG. 1 there is illustrated an automatic washer generally at 10 having an outer cabinet 12 to surround and enclose a wash load receptacle and drive mechanism. The wash load receptacle is composed of an imperforate wash tub 14 and a concentric inner perforate wash basket 16. A vertical axis agitator 18 is concentrically located within the wash basket 16 and is driven by means of an agitator shaft 20 which extends through the floor of the wash basket 16 and wash tub 14 to be driven by an electric motor 22 through an appropriate power transmission arrangement such as that described below. The washer cabinet 12 has a top openable lid 24 and has a console 26 at the rear edge of the top of the washer which includes a plurality of control dials 28 to permit a user to select a series of automatic washing, rinsing and dehydration steps.

Figure 2:
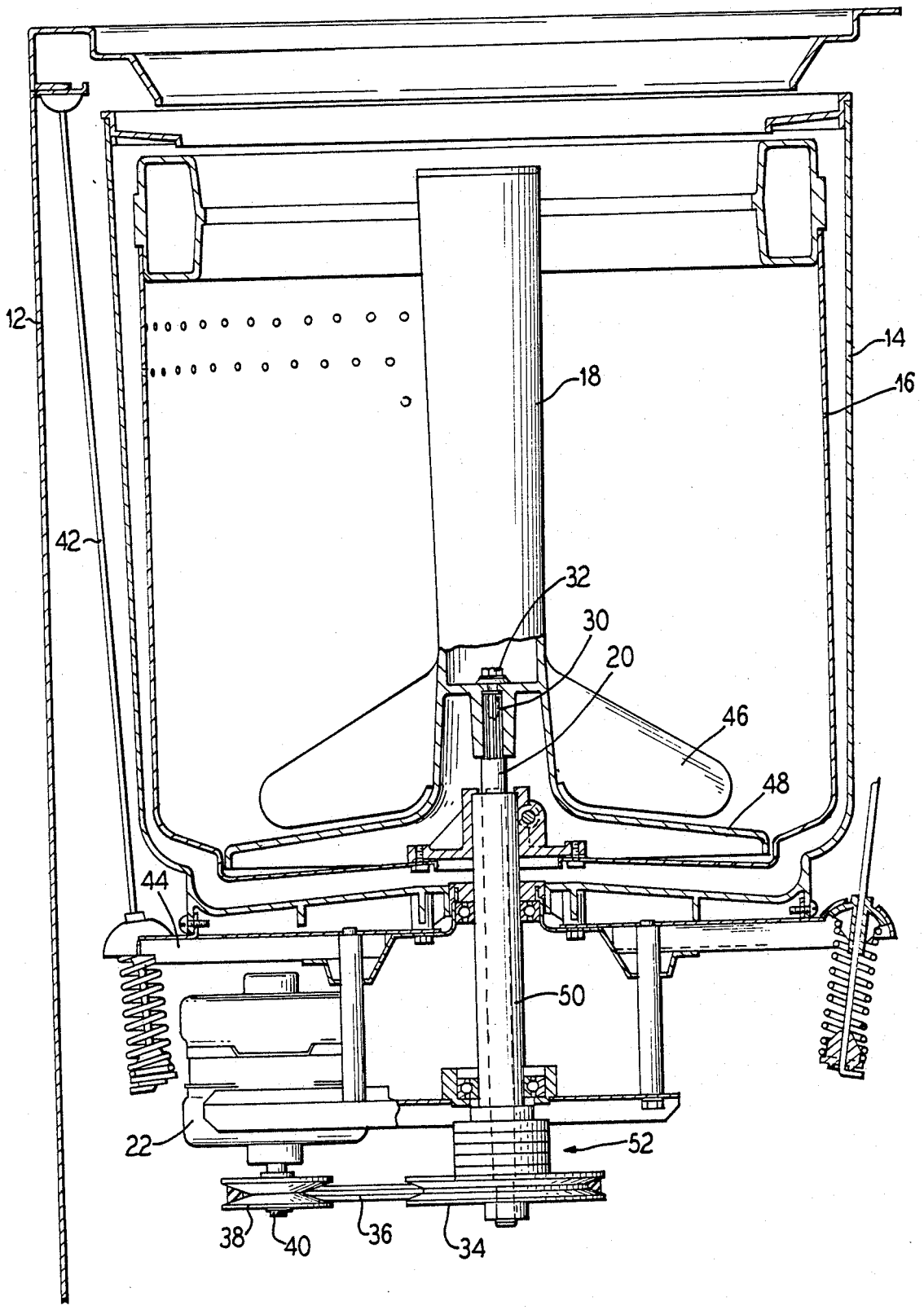
FIG. 2 is a side sectional view through the interior of the washing machine of FIG. 1.
Figure 6:
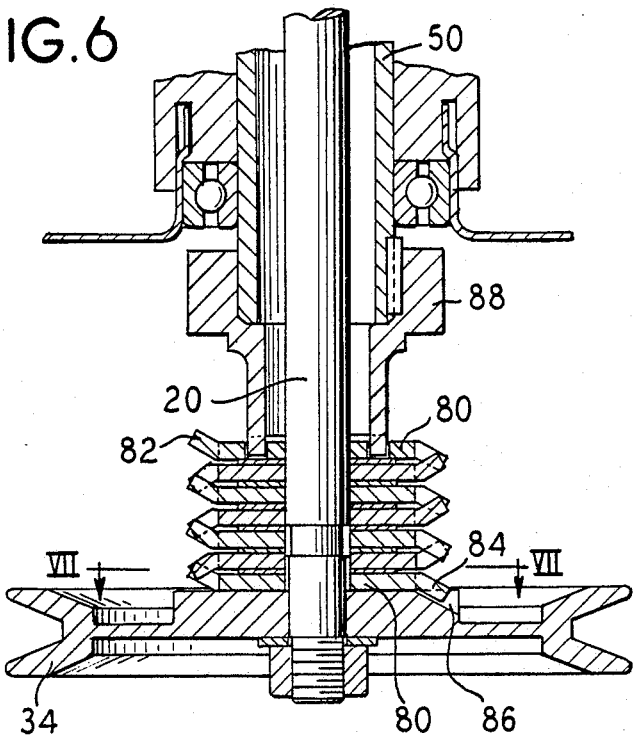
FIG. 6 is a side sectional view illustrating a second embodiment of the discs incorporating the principles of the present invention.
Figure 9:
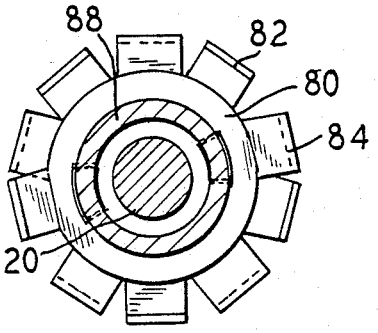
FIG. 9 is a top view of a plurality of stacked discs.
Figure 8:
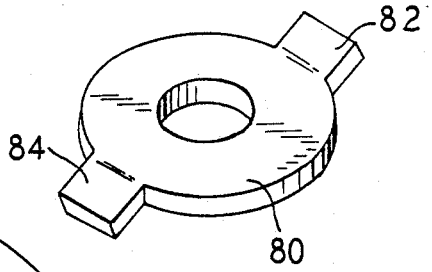
FIG. 8 is a perspective view of a disc illustrated in FIGS. 6 and 7.
Figure 7:
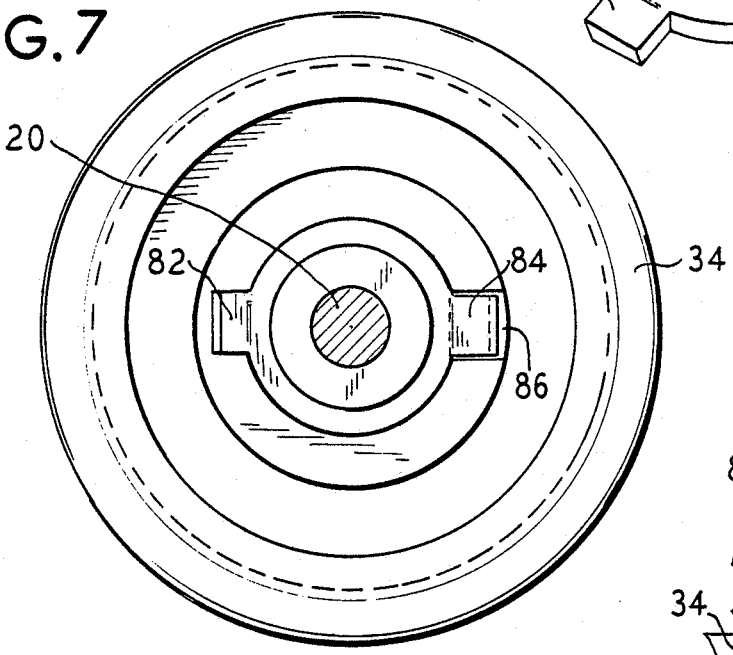
FIG. 7 is a top sectional view of the agitator shaft and discs taken generally along the line VII—VII of FIG. 6.
Figure 10:
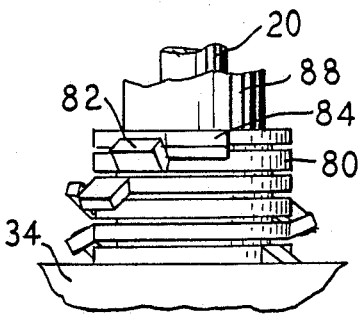
FIG. 10 is a side elevational view of a plurality of stacked discs.

The interior of the washer is shown in greater detail in FIG. 2 where it is seen that the agitator 18 is connected to the agitator shaft 20 by appropriate fastening means which may include a spline connection 30 and a retaining screw 32. The agitator shaft extends downwardly and is secured to a driven pulley 34 which is connected by means of a drive belt 36 to a drive pulley 38 mounted on a drive shaft 40 of the motor 22. Thus, the agitator is driven by the motor 22 through the pulley and drive belt transmission arrangement. This type of a drive arrangement has many advantages, such as being able to quickly change pulley diameters to cause the machine to run at different speeds, for example when switching between 60 cycle current and 50 cycle current in different countries.

The wash tub 14 and wash basket 16 are shown as being suspended from the suspension rods 42 which are resiliently mounted to a base plate 44 beneath the wash basket and wash tub. The motor and drive connection are all suspended from the base plate 44.

During a normal wash cycle, the agitator 18 is oscillated about its vertical axis such that lower vanes 46 operate as pumping arms to cause a toroidal flow of wash liquid downwardly along the agitator body, outwardly along the skirt 48 of the agitator and upwardly along the wall of the wash basket 16. This toroidal flow increases turnover of the clothes in the wash basket thus enhancing washability.

During the dehydration or liquid extraction stage of the wash cycle, the wash basket 16 is spun at high rate of speed to cause a centrifugal extraction of the wash liquid through the perforate wall of the basket. The wash basket 16 is driven by the motor 22 through the connection of a spin tube 50 which connects to the wash basket at a top end and which is indirectly connected to the driven pulley 34 at a bottom end by means of a delay mechanism shown generally at 52. A first embodiment of the delay mechanism is shown in greater detail in FIGS. 3–5 which illustrate a plurality of stacked discs 54 carried on the agitator shaft 20. Each individual disc comprises a generally circular member having an upstanding circumferential wall 56 extending axially from a floor portion 58. A central hub portion 60 also projects axially upwardly and terminates at a top wall 62 which is coplanar with a top wall 64 of the circumferential wall. Thus, an annular channel 66 is formed between the circumferential wall 56 and the hub 60. An axially upwardly extending lug or tab 68 is positioned in the annular channel 66 which also terminates flush with the tops of the circumferential wall and hub. In the top disc, there is mounted a connecting element 70 which provides the driving connection between the top disc and the spin tube 50. In each of the remaining discs there is mounted an elastomeric bumper 72 in a space between the hub 60 and the upwardly projecting lug or tab 68. The elastomeric bumper 72 projects beyond the side walls of the lug 68 into the annular channel.

On the bottom side of each disc there is a downwardly projecting tab or lug 74 which is spaced slightly inwardly from the circumferential edge of the disc so that when two discs are stacked together, the downwardly projecting lug of an upper disc will be received in the annular channel of the lower disc. The lowermost disc has its downwardly projecting tab 74 extending into an annular channel between the pulley rim and the pulley hub where it is engagable by an upwardly axially extending drive lug 76 formed on the pulley. Thus, as the pulley rotates, the drive lug 76 will engage the downwardly depending lug on the bottom disc causing the bottom disc to rotate with the pulley. Upon continued rotation of the pulley and drive disc in the same direction of rotation, the bottom disc will rotate until the upwardly extending lug 68 of the bottom disc approaches engagement with the downwardly extending lug of the next upwardly adjacent disc.

Figure 4:
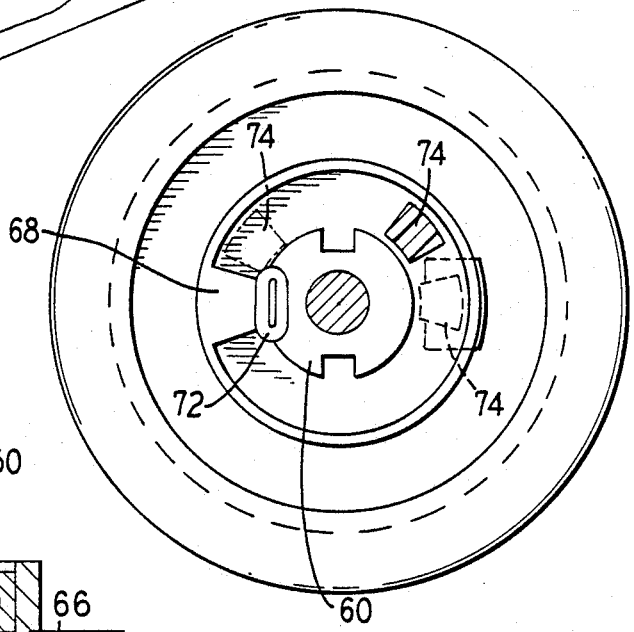
FIG. 4 is a sectional view taken generally along the line IV—IV of FIG. 3.

Just prior to engagement of the two opposed lugs, the elastomeric bumper 72 carried by the bottom disc will engage the downwardly depending lug 74 of the next upper disc. This is illustrated in FIG. 4 wherein the downwardly extending lug 74 of the next upper disc is shown in full at the 2 o'clock position and is shown in dotted lines in engagement with the bumper at the 10 o'clock position. By providing the resilient bumper, the driving engagement between adjacent discs is cushioned at the point of impact to reduce or eliminate noise and to reduce shock to the parts. Once the bottom two discs are engaged together by the opposing lugs, they both rotate with the pulley and in succeeding fashion each of the remaining upper discs are picked up and carried in rotation until finally the top disc is picked up which causes the spin tube to rotate.

Figure 5:
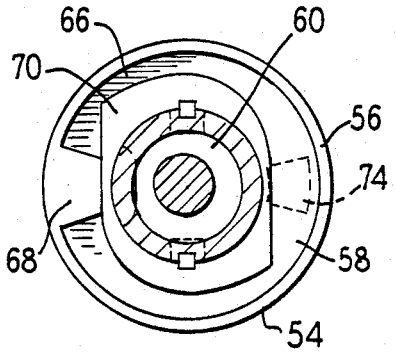
FIG. 5 is a sectional view of the agitator shaft and disc taken generally along the lines V—V of FIG. 3.

As can be seen in FIGS. 4 or 5, each lug comprises an angular extent of approximately 20°, thus providing loss motion of approximately 340° per disc. This amount of lost motion can be reduced by making the disc smaller while keeping the lug approximately the same size, therefore the lug comprising a larger relative angular extent, and the amount of lost motion per disc can be increased by reducing the size of the lug or making the disc larger so that the lug will comprise a relatively smaller angular extent. The total lost motion of the system can be changed by changing the number of discs which are in the stacked arrangement, each new disc adding the per disc angle of lost motion. Thus it is seen that several rotations of lost motion are easily obtainable through the use of a few discs.

Therefore, during the agitate portion of the motion, the motor may be operated in an oscillatory manner to provide alternating rotation to the agitator shaft 20. Since this alternating motion would be held below the amount of lost motion attributable to the disc stack, the wash basket would not be driven during this phase of the wash cycle. However, when the wash cycle moves into the spin phase, the motor would be operated in a single direction and, after sufficient number of rotations of the pulley 34, all of the discs would be picked up and the basket 16 would be rotated along with the agitator 18 to provide the centrifugal extraction of the wash liquid from the clothes load.

An alternative embodiment of the lost motion device is illustrated in FIGS. 6–10 in which a plurality of discs 80 (seen best in FIG. 8) are stacked on the agitator shaft 20 to provide the desired lost motion. Each disc 80 is comprised of a circular member having a first radial tab or lug 82 which is bent or angled axially upwardly and a second, opposed tab or lug 84 which is bent or angled axially downwardly. The lowermost disc 80 has its downwardly extending lug 84 captured in a cut out 86 in the driven pulley so that it will rotate with the pulley. As the lower discs are successively picked up during rotation of the pulley, the top ring is finally also picked up so that the entire stack of discs will rotate. A connecting member 88 connects the top disc to the spin tube 50 to provide rotation of the spin tube once all of the discs have been picked up.

Figure 3:
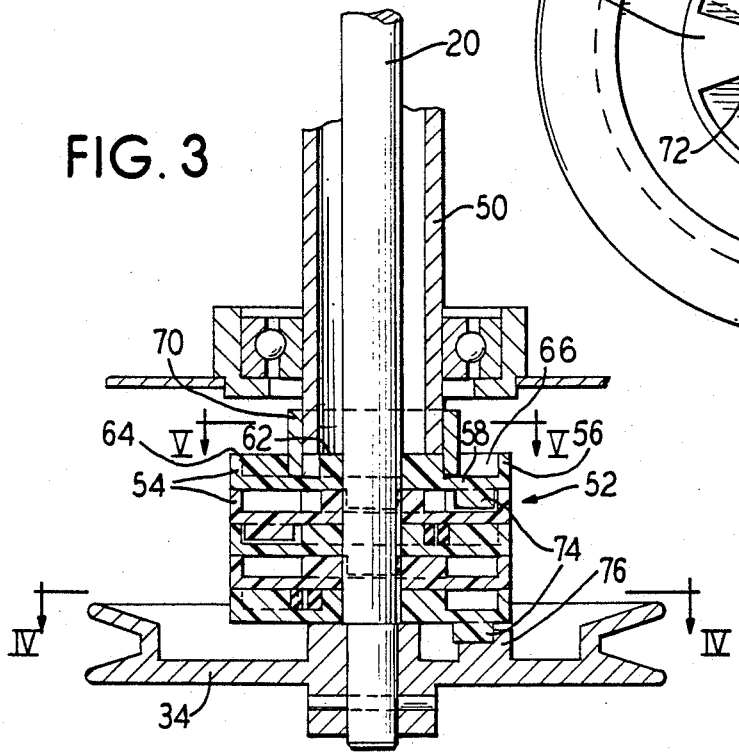
FIG. 3 is a side elevational view of the agitator shaft showing a first embodiment of the discs of the present invention.

As in the first described embodiment of FIGS. 3–5, the angle of lost motion per disc with the second embodiment can be changed by changing either the size of the lugs or the diameter of the discs and the overall lost motion can be changed by increasing or decreasing the number of discs in the stack.

Thus, with both embodiments, there is provided a lost motion mechanism which permits a single drive arrangement, that being of the pulley 34 and the associated agitator shaft 20 to impart oscillatory motion the agitator 18 without effecting movement of the wash basket, even if the oscillation of the agitator extends through more than a 360° agitation stroke. Once the driven pulley 34 is rotated beyond the lost motion angle, then the wash basket 16 is automatically picked up and rotated along with the agitator without the need for additional or special clutching arrangements other than the very simple stacked disc arrangement.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. In an automatic washer having a vertical axis agitator driven in an oscillatory manner by a motor during an agitate portion of a wash cycle, and a wash basket mounted concentrically around said agitator to spin with said agitator during a dehydration portion of a wash cycle, a rotational delay mechanism comprising:

a first member rotationally driven by said motor;

at least one additional member rotationally driven by said first member;

engagement means formed on said first member and on said additional member to provide positive driving engagement between said first member and said additional member only after said first member has rotated to a predetermined angular position relative to said additional member;

a top additional member having a driving connection to said wash basket such that rotation of said top additional member will cause rotation of said wash basket.

2. In an automatic washer having a vertical axis agitator driven in an oscillatory manner by a motor during an agitate portion of a wash cycle, and a wash basket mounted concentrically around said agitator to spin with said agitator during a dehydration portion of a wash cycle, a rotational delay mechanism comprising:

a first member rotationally driven by said motor;

at least one additional member rotationally driven by said first member;

said additional member being driven by said first member only after said first member has rotated to a predetermined angular position relative to said additional member;

a top additional member having a driving connection to said wash basket such that rotation of said top additional member will cause rotation of said wash basket, said first member and said additional member comprising discs having central apertures therethrough for being received on said agitator shaft and having opposed axial extensions thereon to provide for driving engagement between said discs upon relative rotational movement between said discs.

3. A rotational delay mechanism according to claim 2, wherein said axial extensions comprise two radial projections at a circumference of said disc, one projection being angled in one axial direction and the other projection being angled in an opposite axial direction such that oppositely angled projections of adjacent discs will engage upon said relative rotational movement between said discs.

4. A rotational delay mechanism according to claim 2, wherein said axial extensions comprise two axial projections adjacent to a circumference of said disc, one projection being on a first planar side of said disc and a second projection being on an opposite side of said disc such that opposite projections of adjacent discs will engage upon said relative rotational movement between said discs.

5. A rotational delay mechanism according to claim 4, wherein said second projection is located in an annular channel on said opposite side of said disc, a first projection of an adjacent disc being movable within said annular channel.

6. A rotational delay mechanism according to claim 2, wherein an elastomeric bumper is provided adjacent to at least half of said axial extensions to provide a cushioned impact between said adjacent discs.

7. An automatic washer comprising:

a vertical axis agitator;

a wash basket concentrically mounted with said agitator;

a vertical agitator shaft drivingly connected to said agitator at a top end and having a bottom end protruding below said basket;

a motor drivingly connected to said bottom end of said agitator shaft to selectively drive said agitator in an oscillatory manner and a rotational manner;

a lost motion mechanism drivenly connected at a bottom end to said agitator shaft and drivingly connected at a top end to said basket;

said lost motion mechanism comprising a plurality of discs stacked on said agitator shaft, a lowermost of said discs being drivingly connected to said agitator shaft and an uppermost of said discs being engageable with a portion of said basket, said discs having engagement means formed thereon to provide positive driving engagement between each of said discs upon sufficient relative rotational movement between said discs;

said lost motion mechanism absorbing a predetermined amount of rotational movement of said agitator shaft prior to transmitting additional rational movement to said basket;

whereby, oscillatory motion of said agitator shaft is absorbed by said lost motion mechanism and is not transmitted to said basket, but rotational motion of said agitator shaft beyond a predetermined angle does cause driving rotation of said basket.

of said agitator shaft beyond a predetermined angle does cause driving rotation of said basket.

8. An automatic washer according to claim 7, wherein a sufficient number of discs are stacked on said agitator shaft to serially engage such that said lost motion mechanism will absorb more than 720 degrees of rotational movement of said agitator shaft prior to transmitting additional rotational movement to said wash basket.

9. An automatic washer according to claim 7, wherein said engagement means between said discs comprises axial extensions projecting from opposite sides of said discs.

10. An automatic washer according to claim 7, wherein each disc provides at least 270 degrees of lost motion.

11. In an automatic washer having a vertical axis agitator driven in an oscillatory manner by a motor during an agitate portion of a wash cycle, and a wash basket mounted concentrically around said agitator to spin with said agitator during a dehydration portion of a wash cycle, a single shaft agitate and spin drive comprising:

a lost motion mechanism comprising a plurality of discs stacked on said agitator shaft, a lowermost of said discs being drivenly connected to an agitator shaft and an uppermost of said discs being drivingly connected to said basket, said discs having engagement means formed thereon to provide positive driving engagement between each of discs upon sufficient relative rotational movement between said discs;

said lost motion mechanism absorbing a predetermined amount of rotational movement of said agitator shaft prior to transmitting additional rotational movement to said basket;

whereby, oscillatory motion of said agitator shaft is absorbed by said drive and rotational motion of said agitator shaft beyond a predetermined angle causes driving rotation of said basket.

12. A single shaft agitate and spin drive according to claim 11, wherein the amount of rotational motion of said agitator shaft absorbed by said lost motion mechanism is adjustable by changing the number of discs stacked on said agitator shaft.

* * * * *